United States Patent [19]

Frey et al.

[11] Patent Number: 4,604,975

[45] Date of Patent: Aug. 12, 1986

[54] APPARATUS FOR INJECTING FUEL INTO A SECONDARY FLOW OF COMBUSTION AIR FROM A COMBUSTION CHAMBER

[75] Inventors: Thomas Frey, Friolzheim; Werner Grünwald, Gerlingen; Ernst Imhof, Munchingen; Iwan Komaroff, Regensburg; Helmut Reüm; Günther Schmid, both of Stuttgart; Kurt Schmid, Ditzingen-Schockingen, all of Fed. Rep. of Germany

[73] Assignee: Robert Bosch GmbH, Stuttgart, Fed. Rep. of Germany

[21] Appl. No.: 692,450

[22] PCT Filed: Dec. 20, 1983

[86] PCT No.: PCT/DE83/00212

§ 371 Date: Dec. 18, 1984

§ 102(e) Date: Dec. 18, 1984

[87] PCT Pub. No.: WO84/04359

PCT Pub. Date: Nov. 8, 1984

[30] Foreign Application Priority Data

Apr. 27, 1983 [DE] Fed. Rep. of Germany ..... 3315241

[51] Int. Cl.[4] ..... F02B 9/08; F02P 19/00

[52] U.S. Cl. ..... 123/145 A; 123/549

[58] Field of Search ..... 123/254, 298, 145 A, 123/145 R, 557, 549, 294

[56] References Cited

U.S. PATENT DOCUMENTS

| | | | |
|---|---|---|---|
| 433,807 | 8/1890 | Otto | 123/298 |
| 1,462,514 | 7/1923 | Lowe | 123/256 |
| 1,641,421 | 9/1927 | French | 123/145 A |
| 1,693,931 | 12/1928 | Lowe | 123/145 A |
| 2,012,086 | 8/1935 | Mock | 123/263 |
| 3,630,184 | 12/1971 | Wolf | 123/145 A |
| 3,689,195 | 9/1972 | Beesch | 431/208 |
| 3,718,425 | 2/1973 | Weyl et al. | 431/208 |
| 3,926,169 | 5/1975 | Leshner | 123/145 R |
| 4,023,539 | 5/1977 | Noguchi | 123/3 |
| 4,459,948 | 7/1984 | Bauer | 123/145 A |

FOREIGN PATENT DOCUMENTS

| | | | |
|---|---|---|---|
| 3010591 | 10/1980 | Fed. Rep. of Germany | 123/145 A |
| 57-131822 | 8/1982 | Japan | 123/298 |
| 2058914 | 4/1981 | United Kingdom | 123/298 |
| 2101207 | 1/1983 | United Kingdom | 123/145 A |

*Primary Examiner*—Ronald B. Cox
*Attorney, Agent, or Firm*—Edwin E. Greigg

[57] ABSTRACT

An apparatus for injecting fuel into the combustion chamber of an internal combustion engine, having an injection nozzle and following the injection nozzle a partition (12, 23, 29) which is provided with through openings (13) for the injection streams and is embodied as a guide device for a partial flow of combustion air, which flow is accelerated by the injector action of the fuel streams in the through openings (13). A device (26, 24, 32) for preheating the partial flow of combustion air is also secured to the partition (12, 23, 29). In this apparatus, the partial flow of combustion air circulates virtually continuously through the partition (12, 23, 29) embodied as a guide device, and the acceleration caused by the injector action of the fuel streams increases with increasing engine rpm. This has the advantage that over the entire power and rpm range of the engine, a uniform course of combustion and a reduction of toxic emissions is attainable.

14 Claims, 6 Drawing Figures

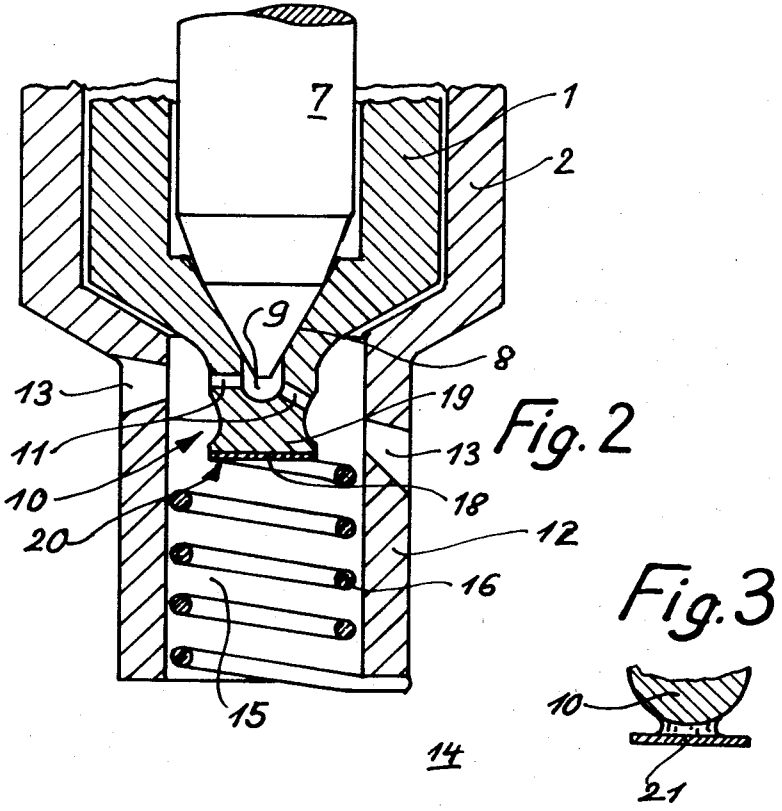
Fig. 2
Fig. 3
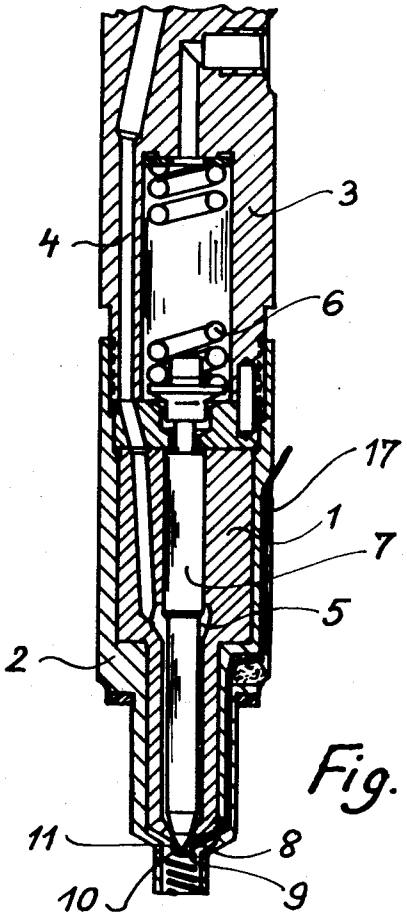
Fig. 1

APPARATUS FOR INJECTING FUEL INTO A SECONDARY FLOW OF COMBUSTION AIR FROM A COMBUSTION CHAMBER

PRIOR ART

The invention is based on an apparatus for injecting fuel as generically defined hereinafter. In a known apparatus of this type (French Pat. No. 1.382.697,FIG. 5), a heating chamber is disposed between the injection port of the fuel injection nozzle and the through opening in the partition between the nozzle and the combustion chamber, and the heating device is disposed in this heating chamber coaxially with the defined fuel stream. At the transition point of the fuel stream through the through opening, a negative pressure is produced by the water-jet pump effect in this heating chamber, as long as injection is taking place. The pressure in this chamber may drop considerably below the ambient air pressure during this process. Then as soon as injection is interrupted, gas flows out of the combustion chamber into the heating chamber, because of the pressure difference. In internal combustion engine injection, the frequency of the intermittent injection is dependent on the rpm, so that at high rpm the pressure of the two chambers will not yet have been equalized by the time a new injection begins. Although this meeting of the fuel flow and the gas flow does cause an intensive, thorough mixing of the fuel and the gas (air), nevertheless it has the disadvantage that this fuel/air mixture varies in accordance with rpm in terms of its proportions of fuel and air. It is accordingly impossible to attain a normally desired fuel/air mixture, one which is predominantly independent of the rpm and is appropriate for ignition. The danger thus exists that premature or late ignitions may occur in a completely uncontrolled manner in certain rpm ranges, which in self-igniting internal combustion engines causes a loss of power and impairs the emissions quality.

A further disadvantage of this known apparatus is that the heat radiation of the heating device meets the fuel stream directly, so overheating occurs on the surface of the fuel stream; given the oxygen usually intermittently present there, the result is a partial pre-combustion. This pre-combustion is followed later by the main combustion, the efficiency of which depends on the quality of the preparation of the fuel/air mixture. This quality can be maintained over the entire rpm range and to the desired extent, however, only if the above-described pre-combustion is constant over the entire rpm range.

Not least, this known apparatus also has the disadvantage in contiunuous injection systems, such as those for heating system combustion chambers, that the negative pressure produced in the heating chamber cannot be compensated for. As a result, air is necessarily aspirated into the heating chamber counter to the direction of the injection stream but traveling past it, which impairs the orientation, shape and velocity of the fuel stream. The fuel stream flutters and usually becomes indented on one side. It loses speed and is poorly distributed in the combustion chamber. The result is increased soot emission and a reduced energy yield.

ADVANTAGES OF THE INVENTION

The apparatus according to the invention has the advantage over the prior art that combustion air is circulated virtually continuously via the bypass and heated by the heating device disposed there. Even if the fuel injection operates intermittently, the flow of combustion air in the bypass never acts counter to the fuel stream but instead has the sole effect of driving the fuel stream along. At relatively high rpm and a correspondingly high injection frequency, the velocity of the air flow through the bypass increases in a comparable manner, so that a correspondingly greater heating capacity is attained. Because of the predominantly uniform heating of the volume thus resulting over the rpm, it is possible to attain on the one hand a substantially more uniform course of combustion and on the other hand an improvement in emissions. A substantial further advantage is that it is the combustion air flowing through the bypass that is primarily heated, and the heating device does not act directly upon the fuel. As a result, disadvantageous carbonization is avoided, as well as nonuniform partial combustion over the rpm. The apparatus according to the invention has a particularly advantageous effect in modern internal combustion engines, having combustion chambers optimized in terms of flow dynamics. In contrast to known apparatus, the apparatus according to the invention does not have a disadvantage in terms of flow dynamics, but can instead be included by the engineer, with the flow function established for it, in the planning of those combustion chambers, as a result of which the flow parameters of the combustion chamber can be improved. Depending on the location of the inlet of the bypass, influence is exerted directly upon the flow in the combustion chamber.

Advantageous further developments of the apparatus are possible by means of the characteristics revealed in the appended specifications.

According to an advantageous embodiment of the invention, the heating element in the bypass is secured to the air guide device. As a result, it is assured that the heating device is always located at the point of most favorable heating action as provided by the engineer, that is, where because of known flow conditions the heating surfaces are grazed optimally by the air.

Disposing the heating element in the air flow upstream of the inlet of the fuel stream is particularly advantageous. Because of the turbulence arising in the flow, the air flowing upstream of the fuel inlet is heated effectively before it comes into contact with the fuel stream. As is well known in the principle of the water-jet pump, air bubbles are carried along by the stream of liquid, so here part of the heated combustion air enters into the cool fuel stream. This mixing is reinforced downstream of the through opening, so that prior to ignition a substantially homogeneous and rich fuel/air mixture is available. The usual aids to starting required for cold starts, such as glow plugs and glow pins, which cause considerable flow losses in the combustion chamber and have a disadvantageous effect on soot emission are no longer necessary when the apparatus according to the invention is used. Furthermore, these known heating devices consume considerable electric current and are therefore less suitable for continuous operation. The apparatus according to the invention, contrarily, functions with relatively little electrical energy and can thus be used for continuous operation.

According to a further embodiment of the invention, a multi-hole nozzle having injection streams extending crosswise to the injection nozzle axis serves as the injection nozzle, and the air guide device is disposed on a nozzle clamping nut with which a nozzle holder body having the injection ports can be clamped onto a nozzle holder. The nozzle clamping nut is fixed in its position relative to the fuel injection nozzle and hence to the combustion chamber, so that the air guide device is accordingly fixed as well. While in the case of pintle nozzles or nozzles that open outward the through opening extends coaxially with respect to the injection nozzle axis, in hole-type nozzles an exact orientation of the through opening in the air guide device and injection ports in the nozzle body is required; this can be accomplished without difficulty given the one-piece embodiment of the air guide device and nozzle clamping nut. The bypass inlet may be disposed either centrally in the air guide device, in fact coaxially with respect to the fuel injection nozzle, or crosswise with respect to the nozzle axis. In the first case, air is additionally pressed out of the combustion chamber into this heating chamber during the compression process, and advantageously a very simple arrangement of the heating device is possible, for instance in the form of a wire heating coil. In the other case, in which the combustion air is aspirated crosswise to the nozzle axis, the heating device is preferably embodied by heating conductors, which are disposed outside the air guide device on the surfaces thereof grazed by the flow, so that the aspirated combustion air is already heated before it enters the bypass. The heating conductor may be attached to either the inside or the outside surfaces of the funnel body and may be variously realized (as a film, flat wire, round wire, etc.).

In cases where the combustion air from the combustion chamber directly strikes the nozzle body tip (rounded end) containing the injection ports, this end can advantageously be protected against the effects of direct heating by a heat insulating layer or by an air guide panel, so as to prevent carbonization in the injection ports and the attendant nonuniform injections.

Further advantageous structural features will become apparent from the ensuing exemplary description and from the drawing.

BRIEF DESCRIPTION OF THE DRAWINGS

Three exemplary embodiments of the subject of the invention are shown in the drawing and will be explained in further detail in the ensuing description. Shown are:

FIG. 1, a fuel injection nozzle in longitudinal section, in which the first exemplary embodiment is realized;

FIG. 2, a detail of FIG. 1 showing the first exemplary embodiment on a larger scale;

FIG. 3, a variant of the heat insulation of the first exemplary embodiment;

DESCRIPTION OF THE EXEMPLARY EMBODIMENTS

Figure 5:
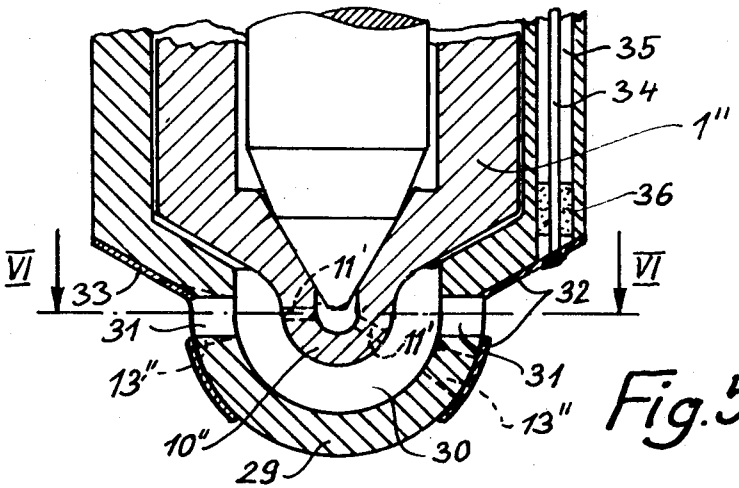
FIG. 5, the third exemplary embodiment in longitudinal section with a radial inflow of air.

A preferred field in which the invention may be applied is the Diesel engine, and the exemplary embodiments described below also relate to its use in a self-igniting internal combustion engine of this kind. All three exemplary embodiments are disposed directly on the fuel injection nozzle of the Diesel engine, one of which is shown by way of example in FIG. 1.

A nozzle body 1 is clamped via a nozzle clamping nut 2 to a nozzle holder 3, which communicates by means of fuel lines, not shown, with an injection pump. The fuel intermittently delivered by the injection pump travels via a pressure conduit 4 to a pressure chamber 5 of the nozzle body 1 and displaces a valve needle 7 in the opening direction, counter to the force of the closing spring 6. Once the valve needle 7 has risen from a seat 8, the pressure chamber 5 communicates with a blind bore 9, branching off from which are injection ports 11 disposed in a nozzle tip 10.

In FIG. 2, this ejection portion of the fuel injection nozzle of the first exemplary embodiment shown in FIG. 1 is shown on a larger scale. The nozzle clamping nut has a tubular section 12 extending coaxially with the injection nozle axis, and in this tubular section 12, through openings 13 for the fuel stream formed via the injection ports 11 are provided. The injection ports 11 and the associated through bores 13 have the same axis. Since the tubular section 12 of the nozzle clamping nut 2 forms a partition between the fuel injection nozzle, and especially the tip 10 there, and the combustion chamber 14 located outside this tubular section 12, the fuel stream must be able to pass through the through bore 13 unhindered. In the combustion chamber 14, the fuel/air mixture then forms in the usual manner and self-ignites, given sufficient compression. Because of the injector effect taking place with the fuel stream in the vicinity of the through opening 13, air is "pumped" out of the chamber 15 enclosed by the tubular section 12 via the through openings 13 and pumped into the combustion chamber 14, whereupon a portion of this air mixes with the fuel stream. As a result of this suction, air flows out of the combustion chamber 14 into this tubular chamber 15 via the open end of the tubular section 12. The tubular chamber 15 thus acts as a bypass for an intended air flow, since flows arise in the combustion chamber 14 as well as a result of the piston operation of the engine and corresponding air guides in the combustion chamber and cylinder. The higher the injection frequency, the higher the flow velocity in the bypass, and the greater the quantity of air pumped through it.

To heat the air entering the bypass 15, a heating coil is disposed in this tubular chamber 15, in fact coaxially with the tubular section 12; it is supplied with electrical energy via the cable 17 shown in FIG. 1 and is grounded with its end 18 via the nozzle tip 10. The air flowing out of the combustion chamber 14 into the heating chamber 15 can be heated accordingly before it comes into contact with the fuel stream. The pump effect brought about by the energy of the stream additionally assures the mixing of this heated air with the fuel stream and thus assures not only the heating of the fuel/air mixture but also its intensive mixing and preparation. This heating and preparation of the fuel/air mixture not only effects better ignitability but also reduces the proportion of soot in the exhaust gas, because more complete combustion of the hydrocarbons is possible.

The combustion air flowing in via the heating chamber 15, however, may be at or may attain a considerable temperature, possibly endangering the nozzle tip from overheating. The danger also exists that because of the high temperatures, the fuel may already carbonize in the injection ports 11 and thereby either restrict or completely block passage therethrough. For this reason, a heat protector 19 is disposed on the tip 10 of the nozzle body 1, crosswise to the flow direction, and the end of this heat protector 19 facing into the flow is provided with a heat-insulating layer 20. The air flow in the bypass 15 that is heated by the heating coil 16 is directed outward and hence toward the through openings 13 by the heat protector 19, thereby avoiding overheating of the tip 10 itself and thus of the injection ports 11 or even of the blind bore 9.

In FIG. 3, as a variant of the heat protector of this first exemplary embodiment, a heat protecting shield 21 is secured on the tip 10', having the same function, described above, as the heat protector 19; however, this shield is relatively easy to dispose on mass-produced hole nozzles, for instance by welding.

Figure 4:
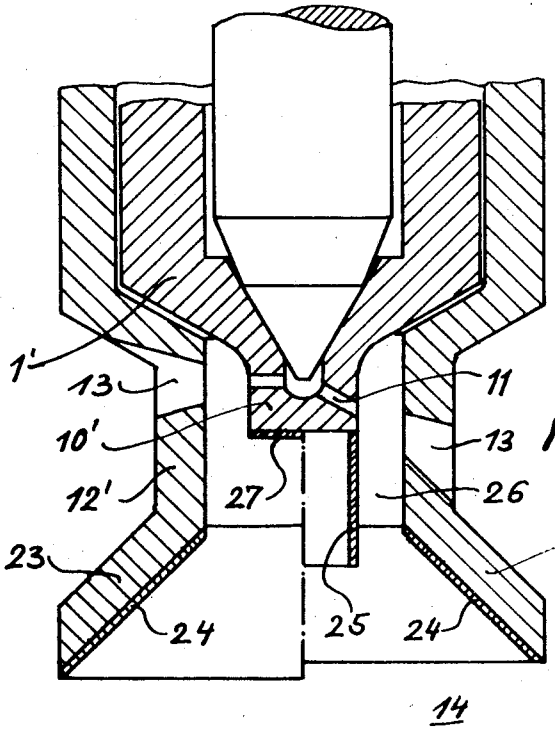
FIG. 4, the second exemplary embodiment in longitudinal section, with a funnel-shaped air inlet.

In the second exemplary embodiment shown in FIG. 4, the tubular section 12' has a funnel-shaped enlargement 23 toward the combustion chamber 14. As a result, the inlet of the bypass is widened accordingly, so that air is aspirated from a larger zone in the combustion chamber 14. This air grazes a heat conductor 24, which is disposed on the inside of the funnel 23. Subsequently, the air then enters the cylindrical section of the air guide device 12', and then flows back into the combustion chamber 14 via the fuel stream and the through openings 13. A heat protector is provided on the end facing into the flow on the tip 10' of the nozzle body 1' of this exemplary embodiment, which is cylindrical in embodiment. Two variants of this heat protector are shown in FIG. 4, one to the right and one to the left of the center axis. The variant on the right is a small tube 25 attached to the nozzle tip 10' and serving as an air guide, which protrudes partway into the funnel 23 and in common with it defines a partly conical annular conduit 26 serving as a bypass. The heated air is moreover drawn to the through openings 13 by the fuel stream before it can reach the injection ports.

In the other variant, shown to the left of the center axis, the protector is again, as in the first exemplary embodiment, a heat insulating layer 27 having a corresponding effect.

Naturally embodiments of the invention are also conceivable in which a conically embodied heating coil for heating the air is disposed in a funnel-shaped air guide tube embodying the bypass, and it is equally conceivable for heating conductors to be provided on the inside walls of a corresponding cylindrical bypass tube. It is also conceivable for a tube having heat conducting surfaces to be disposed in the tube or funnel, preferably coaxially. All these conceivable possibilities are encompassed by the invention, although because of the cost of manufacturing them they must be considered less preferable than the exemplary embodiments shown.

Figure 6:
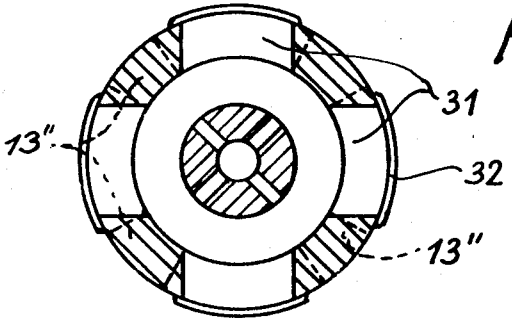
FIG. 6, a section taken along the line VI—VI of FIG. 5.

A third exemplary embodiment is shown in FIGS. 5 and 6, in which the air aspirated out of the combustion chamber 14 flows toward the fuel streams crosswise to the nozzle axis. Since in this exemplary embodiment, which again relates to a hole nozzle, the fuel streams themselves are also ejected crosswise to the injection nozzle axis, the air inflow and outflow is effected substantially in a plane that is crosswise to the injection nozzle axis.

As shown in FIG. 5 in a longitudinal section of the fuel injection nozzle, an air guide device in the form of a dome-like hood 29 is disposed over the tip 10'' of the nozzle body 1'', substantially following the shape of the tip 10'' but with a larger diameter. A hemispherical annular chamber 30, serving as a bypass, is formed between the tip 10'' and this hood 29, and the corresponding through openings and inlet openings disposed in the hood branch off from this chamber 30. Serving as inlet openings are oblong openings 31 disposed in one plane and centrosymmetrically. The plane corresponds to the sectional plane VI—VI of FIG. 5, as shown in FIG. 6. Corresponding to a portion of the injection ports 11, through bores 13' associated with these injection ports 11 are also disposed in this plane. Further through openings 13'' are also disposed coaxially with further injection ports 11', their common axis forming a certain angle with the plane mentioned. The heating of the combustion air is effected via heating conductors 32, which are disposed on the outer jacket face of the hood 29 in such a manner that they are encountered by the inflowing air to the greatest exent possible. Since the air here enters crosswise to the nozzle axis, the conical hood section 33 is coated on the one hand, and on the other the spherical area 29 is coated in the vicinity of the inlet openings 31. No additional heat insulating of the nozzle tip 10'' is required, because the combustion air is ripped out of the bypass once again by the fuel streams before it can actually come into contact with the tip. The electrical connection of the heating conductor 32 is effected via a connection wire 34, which extends in a bore 35 of the nozzle clamping nut and is insulated from the latter by a glass seal 36.

In accordance with the invention it is also conceivable for the heating process to enable two heating stages, which can be put into operation either in alternation or parallel. For instance, a higher heating capacity could be used for cold starting, and a lesser, for instance continuous, heating capacity could be provided as a means of long-term heating in order to improve the course of combustion.

It is equally conceivable for the invention to be realized in pintles or outwardly opening nozzles, in which the fuel stream is then ejected in the nozzle axis. Here the air from the combustion chamber would then enter into the air guide device crosswise to the nozzle axis and then reach the combustion chamber once again, having been accelerated by the fuel stream. In these cases, the air could enter the bypass crosswise to the axis, as in the third exemplary embodiment shown in FIGS. 5 and 6, and then travel via a central opening, corresponding to the inlet opening of the first and second exemplary embodiments, back into the combustion chamber, accelerated by the fuel stream. In accordance with the invention, combustion air is supposed to be aspirated from the combustion chamber and returned to the combustion chamber via a bypass embodied by an air guide device as a result of the injector action of the fuel stream, this bypass flow being heated by heating devices.

The foregoing relates to a preferred exemplary embodiment of the invention, it being understood that other embodiments and variants thereof are possible within the spirit and scope of the invention, the latter being defined by the appended claims.

We claim:

1. An apparatus for injecting fuel into a combustion chamber of an internal combustion engine, in particular a self-igniting internal combustion engine, having an injection nozzle which has injection openings disposed at an angle from the nozzle axis, through which openings laterally-oriented fuel streams emerge from outlets, characterized in that between said injection openings and said combustion chamber a partition is arranged to surround at least the lateral axis of said injection nozzle, said partition being spaced from said injection nozzle and provided with through openings aligned with said fuel streams, said partition containing at least one further opening to admit bypass combustion chamber air such that said partition acts as a guide device for bypassing combustion chamber air from said combustion chamber via said further opening and said through openings back to said combustion chamber whereby said fuel streams which are emitted at and through said through openings bring about an injector effect that accelerates combustion chamber air through said partition, and a heating device between said further opening and said through openings, said heating device being adapted to heat aspirated combustion air before said air passes into said through openings.

2. An apparatus as defined by claim 1, characterized in that said heating device is electrically heatable and asid heating device is secured on said partition.

3. An apparatus as defined by claim 1, characterized in that said heating device is disposed upstream of said outlets of said fuel stream and upstream with respect to said bypass combustion chamber air.

4. An apparatus as defined by claim 1, characterized in that said nozzle body further includes zones exposed to the heated air and injection ports eachof which are provided with heat-protecting means.

5. An apparatus as defined by claim 4, characterized in that a heat insulating layer serves as the heat-protecting means.

6. An apparatus as defined by claim 4, characterized in that a protective panel which is arranged to divert the hot air serves as the heat-protecting means.

7. An apparatus as defined by claim 1, further including a multi-hole nozzle and injection streams which are arranged to extend crosswise relative to the injection nozzle axis, and further wherein the nozzle body can be clamped to a nozzle holder via a nozzle clamping nut, characterized in that the partition is disposed on the nozzle clamping nut.

8. An apparatus as defined by claim 7, characterized in that the partition comprises a tubular section which extends coaxially with the injectin nozzle, said tubular section being open on the end remote from the nozzle and said heating device is disposed in a chamber enclosed by the tubular section.

9. An apparatus as defined by claim 8, characterized in that an electrically heated glow coil which extends coaxially with the tubular section serves as the heating device.

10. An apparatus as defined by claim 8, characterized in that the tubular section further includes an inside wall and that at least one heating conductor is disposed on said wall.

11. An apparatus as defined by claim 8, characterized in that the tubular section has a cylindrical area which widens toward the combustion chamber in a funnel-like manner.

12. An apparatus as defined by claim 1, characterized in that the partition further includes a dome-shaped hool and said hood comprises through bores as well as inflow openings which are arranged to extend crosswise relative to the nozzle axis.

13. An apparatus as defined by claim 12, characterized in that the partition further includes heating conductors which are disposed upstream of the inlet openings.

14. An apparatus as defined by claim 2, characterized in that the heating element is disposed upstream of the inlet of the fuel stream.

* * * * *